US007891452B2

(12) United States Patent
Iwamoto et al.

(10) Patent No.: US 7,891,452 B2
(45) Date of Patent: Feb. 22, 2011

(54) AUTOMOBILE REAR STRUCTURE

(75) Inventors: Hiroaki Iwamoto, Nagoya (JP); Takao Ito, Nishikamo-gun (JP); Haruhiko Yamamoto, Toyota (JP); Ken Tsuruta, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 826 days.

(21) Appl. No.: 11/882,838

(22) Filed: Aug. 6, 2007

(65) Prior Publication Data

US 2008/0036222 A1 Feb. 14, 2008

(30) Foreign Application Priority Data

Aug. 10, 2006 (JP) ..... 2006-218252

(51) Int. Cl.
*B60K 13/04* (2006.01)
*B60K 13/06* (2006.01)

(52) U.S. Cl. ..... 180/89.2; 180/296; 180/309; 180/225

(58) Field of Classification Search ..... 180/69.1, 180/225, 296, 309, 89.2; 293/113
See application file for complete search history.

(56) References Cited

U.S. PATENT DOCUMENTS

| | | | | |
|---|---|---|---|---|
| 2,192,922 | A * | 3/1940 | Lyon | 239/516 |
| 2,850,314 | A * | 9/1958 | Haigh et al. | 293/113 |
| 2,992,035 | A * | 7/1961 | Tell et al. | 293/113 |
| 6,595,318 | B2 * | 7/2003 | Ebinger et al. | 181/227 |
| 6,827,173 | B2 | 12/2004 | Lai | |
| 6,962,230 | B2 * | 11/2005 | Hanaya et al. | 180/309 |
| 7,032,702 | B2 | 4/2006 | Rinklin | |
| 2004/0163874 | A1 | 8/2004 | Rinklin | |

FOREIGN PATENT DOCUMENTS

| | | | |
|---|---|---|---|
| DE | 199 61 316 | A1 | 6/2001 |
| DE | 101 40 435 | C1 | 12/2002 |
| DE | 103 55 472 | A1 | 7/2005 |
| DE | 10 2004 038 782 | A1 | 3/2006 |
| EP | 1 428 743 | A2 | 6/2004 |
| JP | A 7-165126 | | 6/1995 |
| JP | A 2004-196287 | | 7/2004 |
| JP | A-2005-313714 | | 10/2005 |

* cited by examiner

*Primary Examiner*—J. Allen Shriver, II
*Assistant Examiner*—Vaughn T Coolman
(74) *Attorney, Agent, or Firm*—Oliff & Berridge, PLC

(57) ABSTRACT

The automobile rear structure includes a diffuser which is arranged on a vehicle-body rear side of a muffler and is configured to interfere with exhaust gas discharged from the muffler so as to make a portion of the exhaust gas flow downwardly, and a flow rectification plate which is arranged below the muffler and guides the downwardly flowing exhaust gas in the direction along an air flow flowing below the floor of the vehicle body to merge the exhaust gas into the air flow. The exhaust gas discharged downwardly from a space defined between a front end portion of the diffuser and a body portion of the muffler is guided in the direction inclined downwardly toward the rear side of the vehicle body and, thereafter, is guided in the direction along the air flow flowing below the floor of the vehicle body, and is merged into the air flow.

9 Claims, 13 Drawing Sheets

AUTOMOBILE REAR STRUCTURE

CROSS-REFERENCES TO RELATED APPLICATION

This application claims priority under 35 USC 119 from Japanese Patent Application No. 2006-218252, the disclosure of which is incorporated by reference herein.

BACKGROUND OF THE INVENTION

1. Field of the Invention

The present invention relates to the automobile rear structure.

2. Description of the Related Art

Conventionally, there has been proposed the under-floor structure of a rear portion of an automobile having the following constitution (see Japanese Patent Application Laid-Open 7-165126, for example). That is, a rear overhang portion is positioned above an under-floor surface of a wheel base portion, and a muffler having an approximately flattened cross-sectional shape is arranged in a horizontally installed state below the under-floor surface in the vicinity of the rear overhang portion. Further, a lowermost surface of the muffler is positioned above the under-floor surface of the wheel base portion and below a lower end of a rear bumper. This under-floor structure can prevent the lowering of a flow speed of air which flows below a floor of a vehicle body and the peeling-off of such air by making the muffler function as an aerodynamic part thus enhancing the aerodynamic performance of the automobile.

Here, there may exist a case that a portion of exhaust gas discharged from the muffler enters a space defined between a rear bumper cover and the vehicle body, and such exhaust gas which enters the space defined between the rear bumper cover and the vehicle body and a pressure thereof are discharged downwardly from a space defined between the rear bumper cover and the vehicle body, and is vertically merged with an air flow below the floor of the vehicle body. In this case, the air flow below the floor of the vehicle body is disturbed thus becoming a cause to deteriorate the aerodynamic performance of the automobile.

SUMMARY OF THE INVENTION

The present invention is made under such circumstances and it is an object of the present invention to acquire the automobile rear structure which can prevent an air flow which flows below a floor of a vehicle body from being disturbed by exhaust gas discharged from a muffler.

According to a first aspect of the present invention, there is provided the automobile rear structure which includes: a rear-side arranged member which is arranged on a vehicle-body rear side of a muffler and is configured to interfere with exhaust gas discharged from the muffler so as to make a portion of the exhaust gas flow downwardly; and a flow rectification member which is arranged below the muffler and guides the downwardly flowing exhaust gas in the direction along an air flow flowing below the floor of the vehicle body to merge the exhaust gas into the air flow.

According to the automobile rear structure of the first aspect of the present invention, a portion of the exhaust gas which is discharged from the muffler and flows downwardly while interfering with the rear-side arranged member is guided in the direction along the air flow which flows below the floor of the vehicle body by the flow rectification member arranged below the muffler, and is merged into the air flow.

Accordingly, it is possible to prevent the air flow which flows below the floor of the vehicle body from being disturbed by the exhaust gas discharged from the muffler.

In the automobile rear structure of the first aspect of the present invention, the rear-side arranged member may include a diffuser which is formed in a cylindrical shape and houses a muffler pipe of the muffler inside an opening portion on a front-end side thereof, and which discharges the exhaust gas discharged from the muffler pipe from an opening end portion of a rear-end side thereof, and wherein a portion of the exhaust gas may be discharged downwardly through a space defined between a front end portion of the diffuser and a body portion of the muffler, and the flow rectification member may be provided at a lower portion of a front end portion of the diffuser.

In the automobile rear structure having the above-mentioned constitution, the exhaust gas discharged downwardly from a space defined between the front end portion of the diffuser and the main portion of the muffler is guided in the direction along the air flow which flows below the floor of the vehicle body by the flow rectification member which is mounted on a lower portion of the front end portion of the diffuser and is merged into the air flow. Accordingly, it is possible to prevent the air flow which flows below the floor of the vehicle body from being disturbed by the exhaust gas discharged from the space defined between the front end portion of the diffuser and the main portion of the muffler.

Further, the flow rectification member may be formed by a lower portion of the front end portion of the diffuser being folded toward a radial inside. The exhaust gas is guided by the flow rectification member that is formed by the lower portion of the front end portion of the diffuser being folded toward the radial inside.

In the automobile rear structure having the above-mentioned constitution, the flow rectification member may include a flow rectification plate which is mounted at the lower portion of the front end portion of the diffuser. The exhaust gas is guided by the flow rectification panel which is mounted at the lower portion of the front end portion of the diffuser.

In the automobile rear structure of the first aspect of the present invention, the rear-side arranged member may include a rear bumper cover, a portion of the exhaust gas may be discharged downwardly from a space defined between the rear bumper cover and the vehicle body, and the flow rectification member may be provided at a lower portion of the rear bumper cover.

In the automobile rear structure having the above-mentioned constitution, the exhaust gas discharged downwardly from the space defined between the rear bumper cover and the vehicle body is guided in the direction along the air flow which flows below the floor of the vehicle body by the flow rectification member which is mounted on a lower portion of the rear bumper cover and is merged into the air flow. Accordingly, it is possible to prevent the air flow which flows below the floor of the vehicle body from being disturbed by the exhaust gas discharged from the space defined between the rear bumper cover and the vehicle body.

In the automobile rear structure of the first aspect of the present invention, the rear-side arranged member may include a rear bumper cover, wherein a floor cover, which allows a rear end portion thereof to overlap a lower end portion of the rear bumper cover and has discharge hole formed in a rear end side of the floor cover, may be arranged below the floor of the rear portion of the vehicle body, a portion of the exhaust gas may be discharged downwardly from the discharge hole, and the flow rectification member may have an inclined portion provided at a peripheral portion of the discharge hole.

In the automobile rear structure having the above-mentioned constitution, the exhaust gas discharged downwardly from the discharge hole formed in the floor cover is guided in the direction along the air flow which flows below the floor of the vehicle body by the inclined portion provided at the peripheral portion of the discharge hole, and is merged into the air flow. Accordingly, it is possible to prevent the air flow which flows below the floor of the vehicle body from being disturbed by the exhaust gas discharged from the discharge hole formed in the floor cover.

In the automobile rear structure of the first aspect of the present invention, the flow rectification member may include a first guide portion inclined downwardly toward the rear-side of the vehicle body, and a second guide portion which extends toward the rear of the vehicle body from a lower end of the first guide portion.

In the automobile rear structure having the above-mentioned constitution, the exhaust gas which flows downwardly while interfering with the rear-side arranged member is guided in the direction inclined downwardly toward the rear side of the vehicle body by the first guide portion of the flow rectification member and, thereafter, is guided toward the rear portion of the vehicle, that is, in the direction along the air flow which flows below the floor of the vehicle body by the second guide portion of the flow rectification member. In this manner, the exhaust gas can be guided by forming two guide portions formed in the flow rectification member and hence, the flow rectification member can have the simple constitution.

DETAILED EXPLANATIONS OF THE INVENTION

Figure 1:
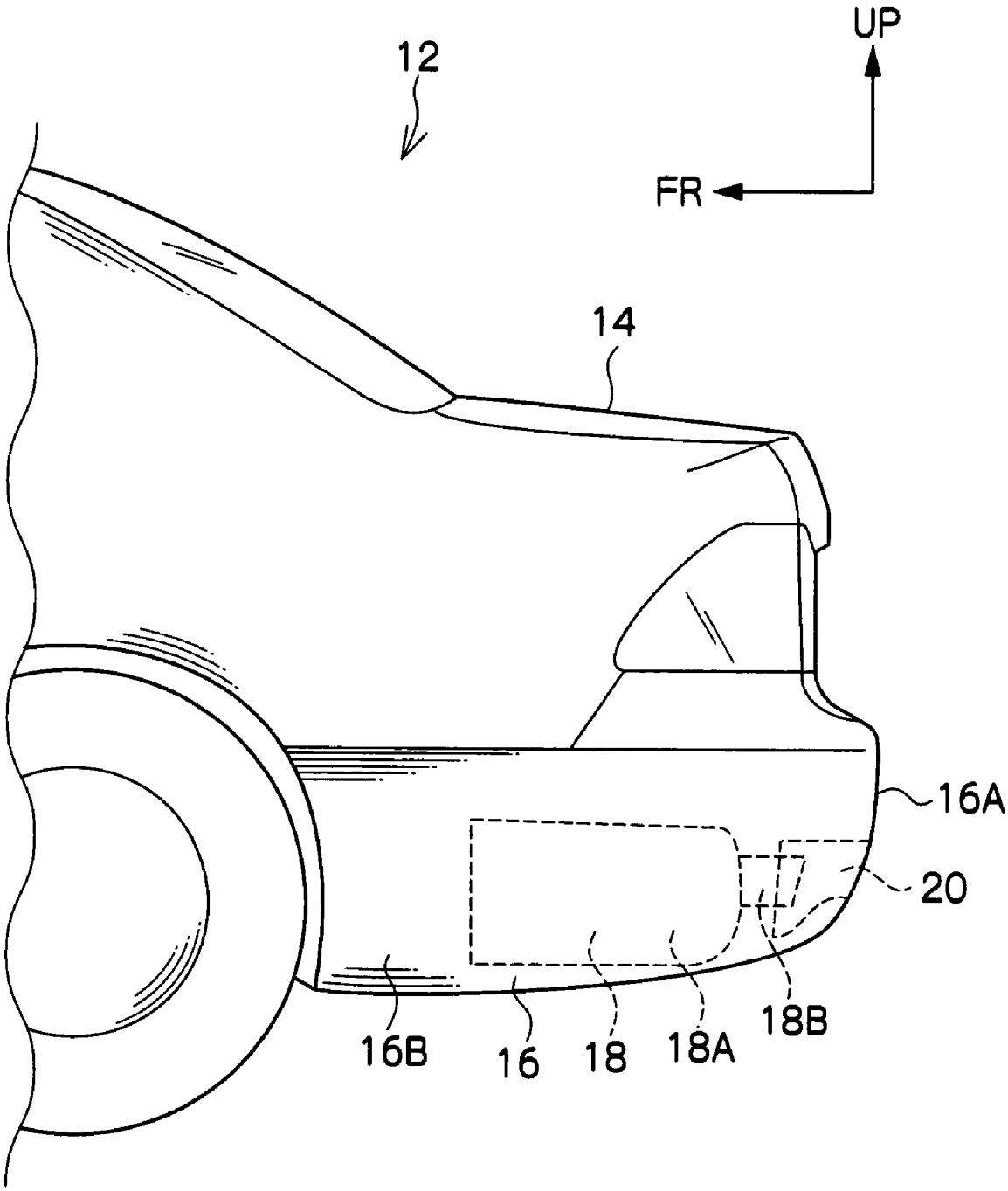
FIG. 1 is a side view of a rear portion of an automobile which is constituted by applying the automobile rear structure according to an embodiment of the present invention.

An embodiment of the present invention is explained in conjunction with FIG. 1 to FIG. 13. Here, in the drawings, an arrow FR indicates the vehicle front direction, an arrow UP indicates the vehicle upper direction and an arrow W indicates the vehicle width direction.

Figure 2:
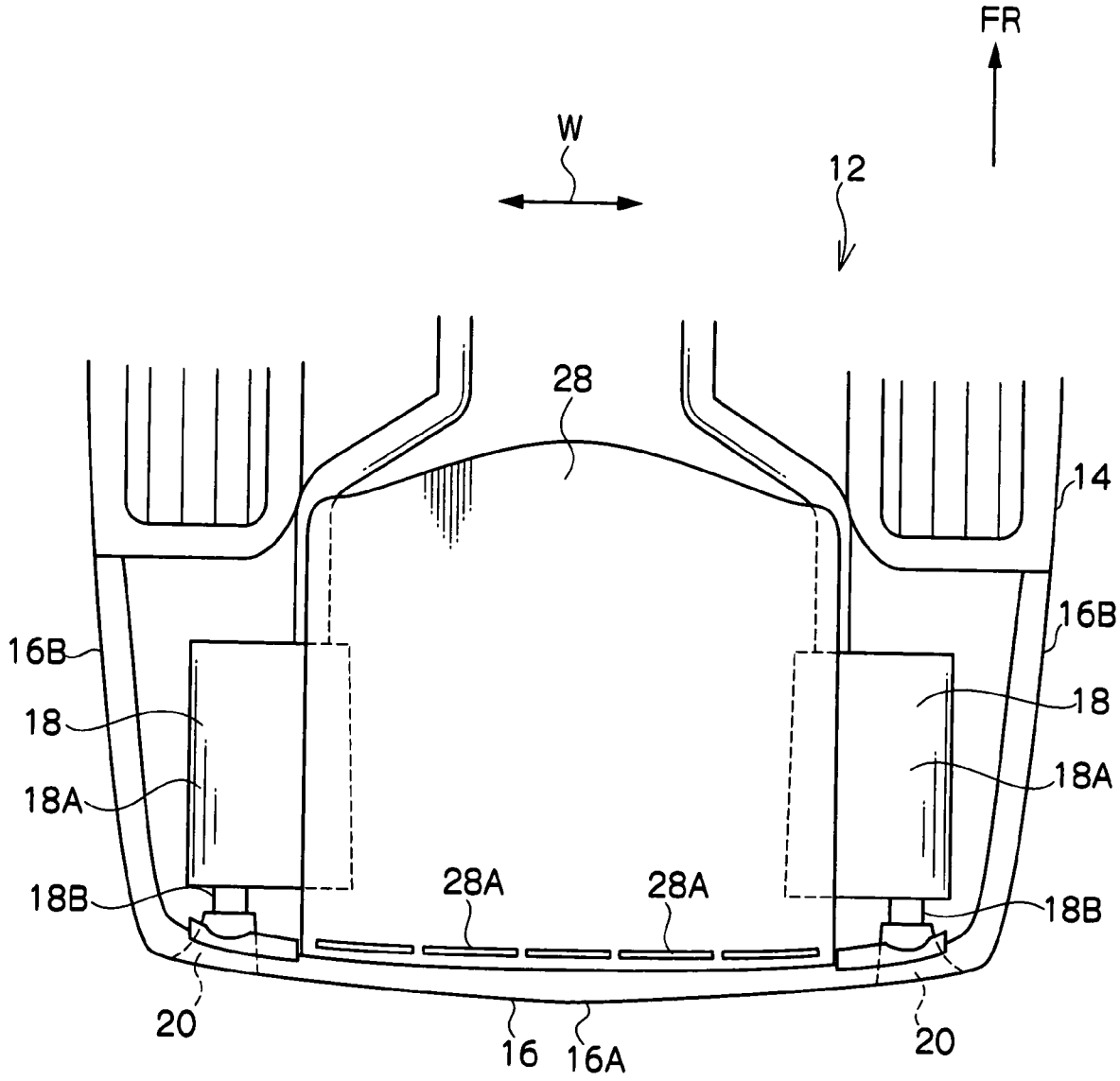
FIG. 2 is a bottom plan view of the rear portion of the automobile shown in FIG. 1.

FIG. 1 is a side view showing the constitution of a rear portion of an automobile 12 which is constituted by applying the automobile rear structure according to an embodiment of the present invention. FIG. 2 is a bottom plan view showing the constitution of the rear structure of the automobile 12. As shown in FIG. 1 and FIG. 2, a rear bumper cover 16 is mounted on the rear portion of a vehicle body 14 of the automobile 12. The rear bumper cover 16 includes a cover body 16A which is arranged in a rearmost end portion of the automobile 12 in the vehicle-width direction and side wall portions 16B which extend to a front portion of the vehicle from both end portions thereof in the vehicle-width direction.

In front of the cover body 16A, a pair of mufflers 18 is arranged on both sides in the vehicle-width direction. The muffler 18 includes a body portion 18A and a muffler pipe 18B which projects rearwardly from the body portion 18A and discharges exhaust gas generated by an engine not shown in the drawing from the muffler pipe 18B to the rear side (a cover body 16A side).

As shown in FIG. 2, a diffuser 20 is mounted on both end portions of the cover body 16A in the vehicle width direction respectively. The diffuser 20 is formed into a substantially trumpet-shaped tube using a metal material. As shown in FIG. 3 to FIG. 7, the diffuser 20 has a front-end-side opening portion 20A thereof which is arranged at the vehicle front side and formed as an approximately circular shape, and a rear-end-side opening portion 20B thereof which is arranged at the vehicle body rear side and formed in substantially elongated rectangular shape along the vehicle width direction. The diffuser 20 is, as shown in FIG. 8, fastened to the rear bumper cover 16 using a plurality of bolts in a state that the rear end portion of the diffuser 20 is arranged at the inside of a through hole 22 formed in the cover body 16A, wherein the outside (vehicle body rear side) and the inside (vehicle body front side) of the cover body 16A are communicated with each other by way of the inside of a cylinder of the diffuser 20. Here, a buffle portion 20C which covers a hole periphery portion of the through hole 22 is formed on the rear end portion of the diffuser 20.

A muffler pipe 18B of the muffler 18 is approximately coaxially housed in the inside of the front-end-side opening portion 20A of the diffuser 20. Due to such a constitution, exhaust gas discharged from the muffler pipe 18B passes through the inside of the cylinder of the diffuser 20 and is discharged toward the vehicle body rear side from the rear-end-side opening portion 20B of the diffuser 20 (see an arrow A in FIG. 8). However, when an amount of the exhaust gas discharged from the muffler pipe 18B is increased, a high pressure is generated in the inside of the diffuser 20 and a portion of the exhaust gas may flow backwardly towards the vehicle body front side. Further, the exhaust gas which flows backwardly and a pressure thereof pass through a space defined between the muffler pipe 18B and an inner surface of the front-end-side opening portion 20A and are discharged downwardly from the space defined between the front end portion of the diffuser 20 and the body portion 18A of the muffler 18 (see an arrow B in FIG. 8). Further, the exhaust gas which flows backwardly and the pressure thereof enter a space defined between the cover body 16A of the rear bumper cover 16 and the vehicle body 14 (lower back panel 14A) and are discharged downwardly from a space defined between the cover body 16A and the lower back panel 14A.

Figure 4:
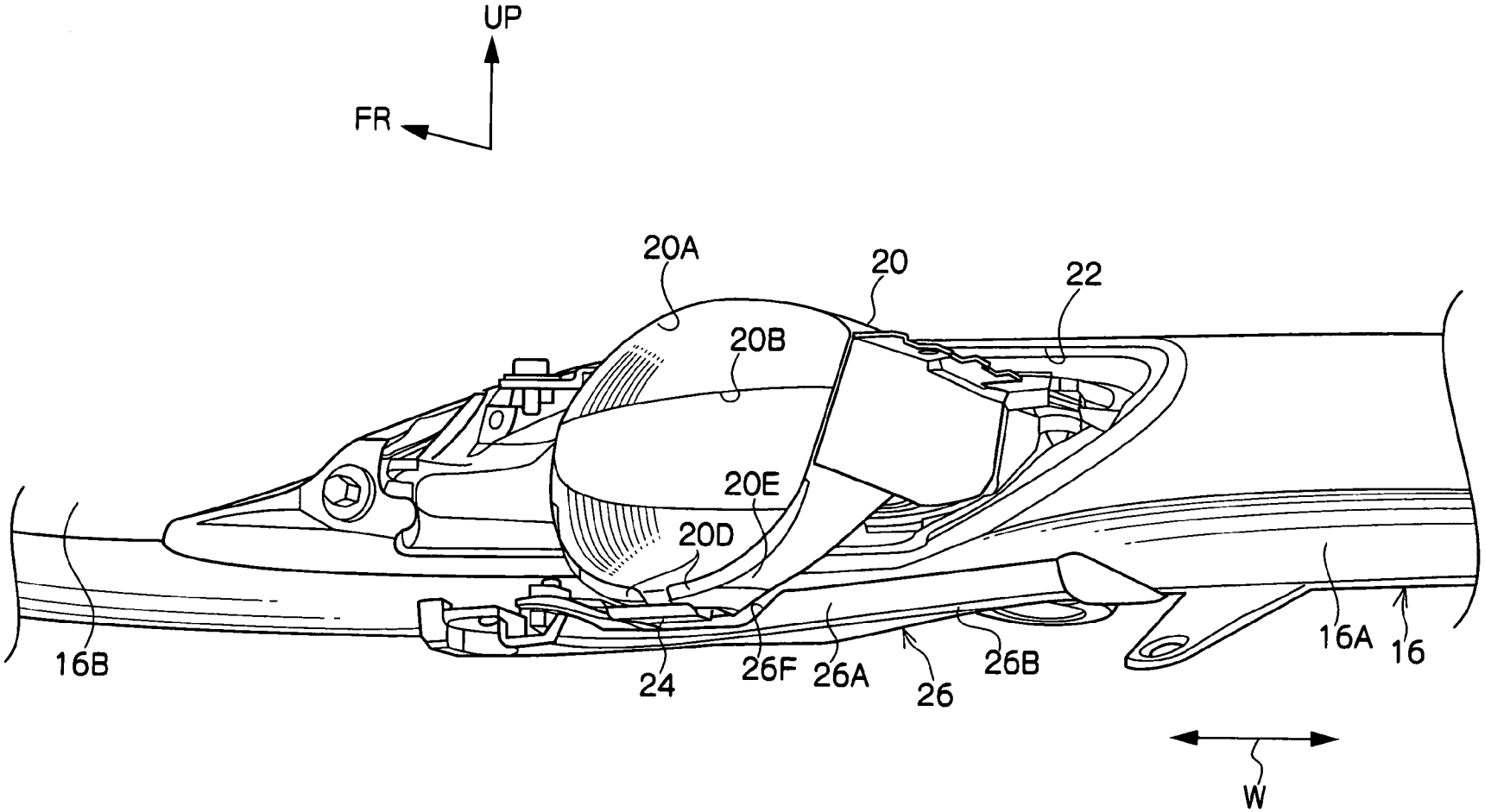
FIG. 4 is a back view of the rear bumper cover of the automobile shown in FIG. 1 in a state that the rear bumper cover is viewed from a front side of the vehicle body.
Figure 5:
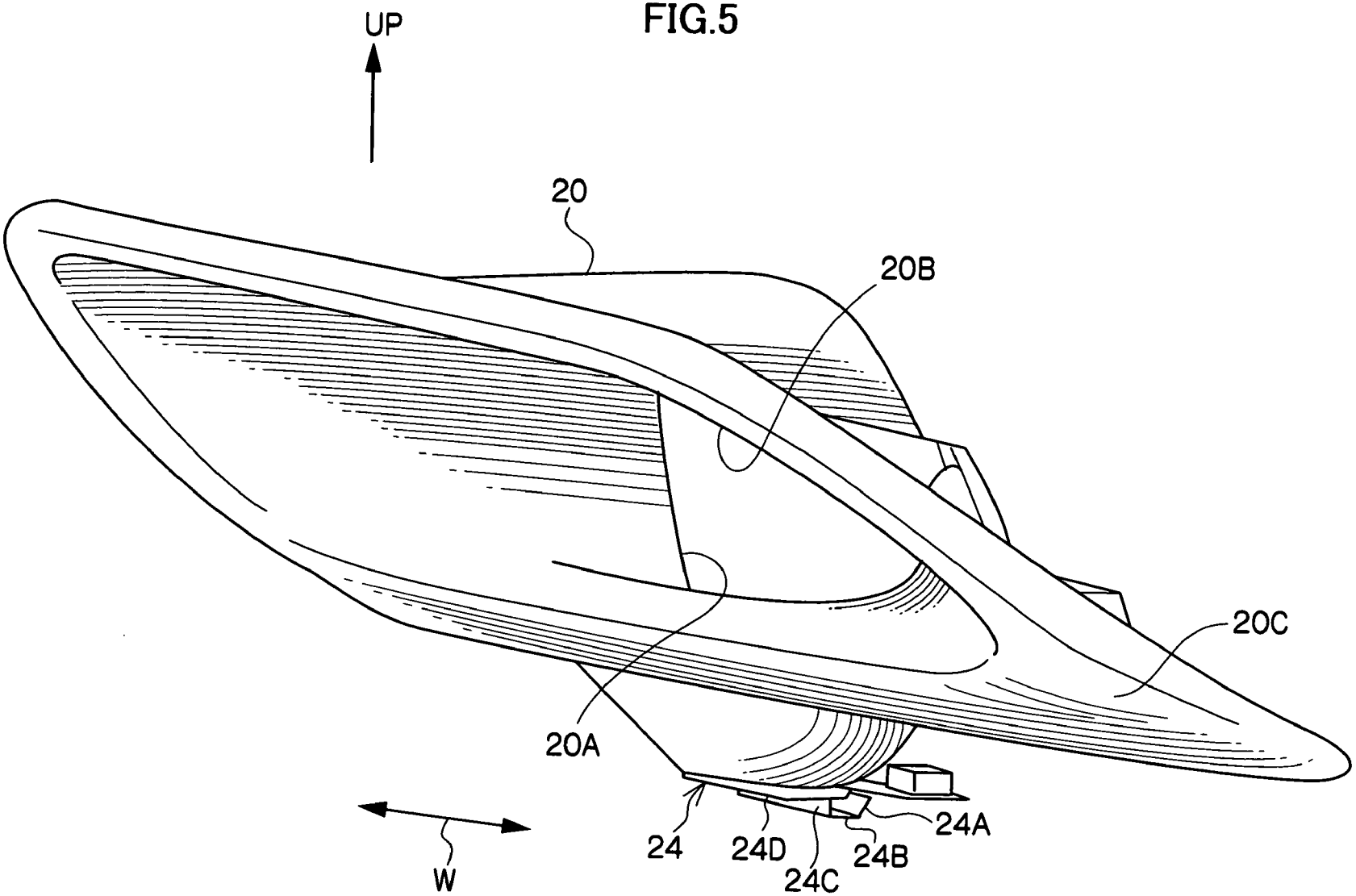
FIG. 5 is a perspective view showing the constitution of a diffuser mounted on the rear bumper cover shown in FIG. 3 and FIG. 4.
Figure 6:
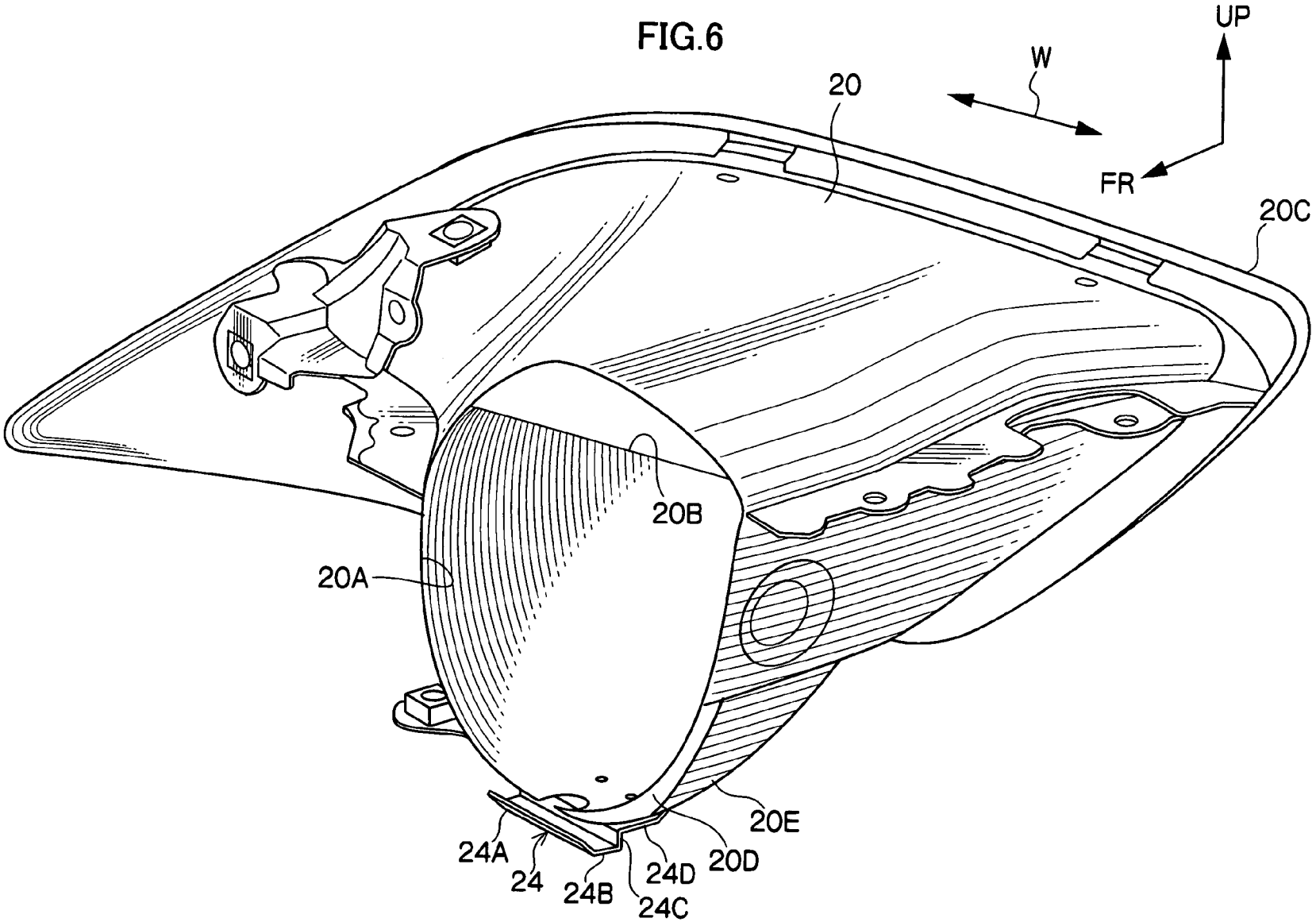
FIG. 6 is a perspective view showing the constitution of the diffuser mounted on the rear bumper cover shown in FIG. 3 and FIG. 4.
Figure 7:
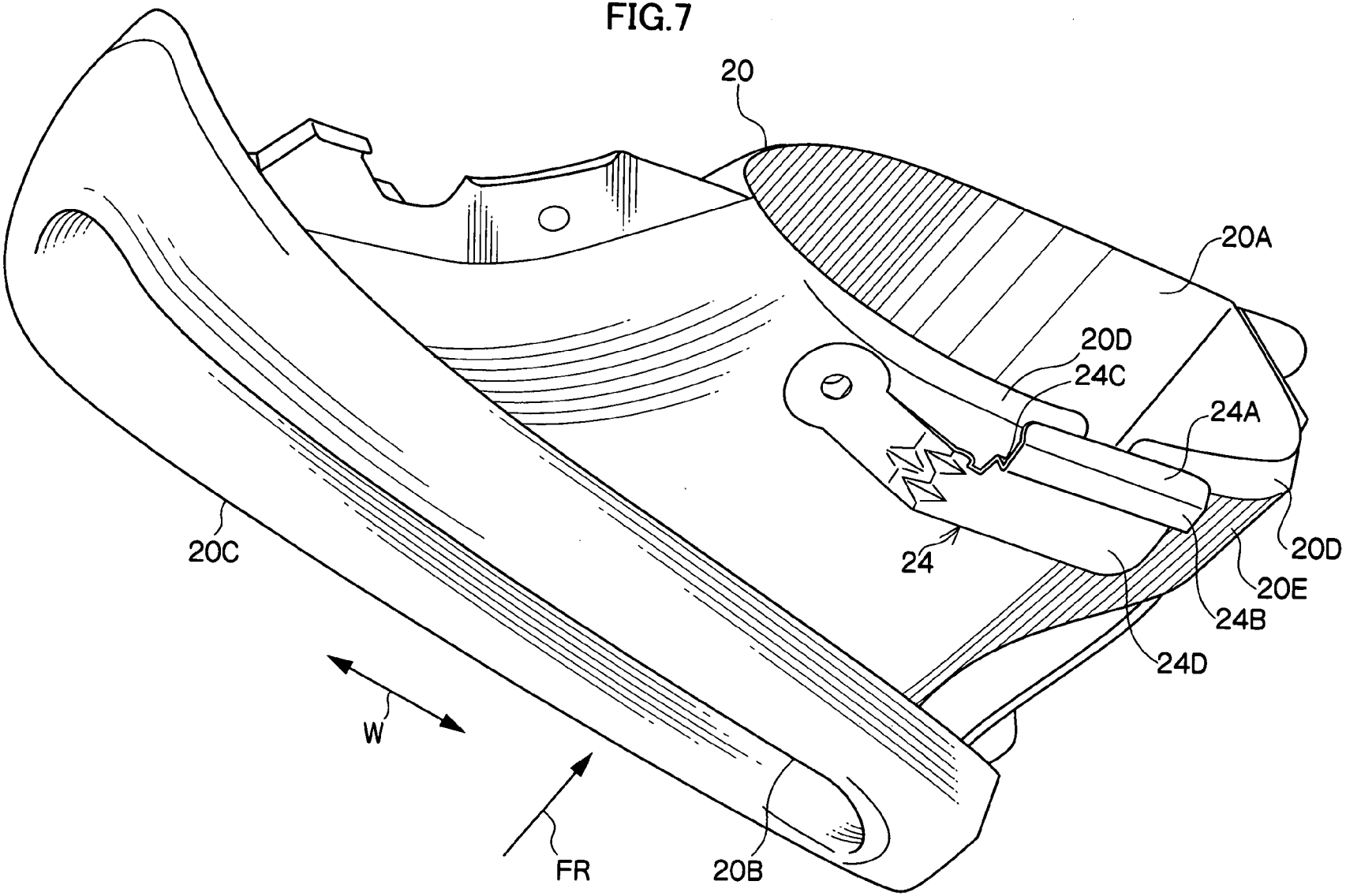
FIG. 7 is a perspective view showing the constitution of the diffuser mounted on the rear bumper cover shown in FIG. 3 and FIG. 4.
Figure 8:
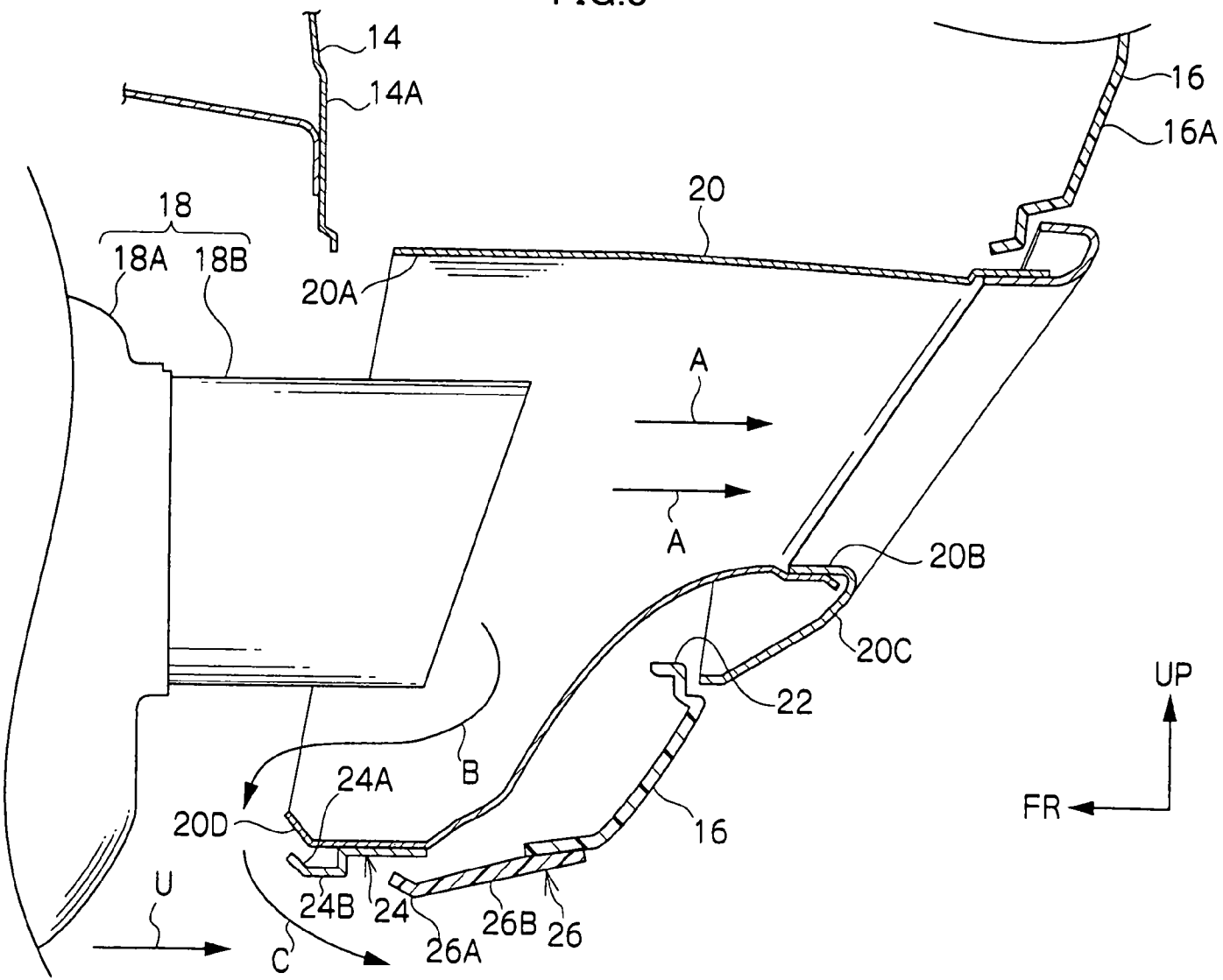
FIG. 8 is a cross-sectional view taken along a line 8-8 in FIG. 3.

Here, in this embodiment, as shown in FIG. 4, FIG. 6 and FIG. 7, a lower portion of the front end portion of the diffuser 20 is folded toward the inside in the radial direction so as to form an inclined portion 20D (flow rectification member) which is inclined downwardly in the vehicle-body-rear-side direction. Accordingly, the exhaust gas discharged downwardly from the space defined between the front end portion of the diffuser 20 and the body portion 18A of the muffler 18 passes through the space defined between the inclined portion 20D and the body portion 18A of the muffler 18. When the exhaust gas passes in this manner, due to a wind pressure of an air flow U (a traveling wind of the automobile 12 which is a rectified flow, see FIG. 8) which flows below a floor of the vehicle body 14, the exhaust gas is made to flow toward the inclined portion 20D side. The exhaust gas which is made to flow toward the inclined portion 20D side is guided in the direction inclined downwardly toward the rear side of the vehicle body by the inclined portion 20D and, thereafter, is guided in the direction along the air flow U by an outer periphery 20E (a flow rectification member) of the front end portion of the diffuser 20 and is merged into the air flow U.

Further, in this embodiment, on a lower end of the front end portion of the diffuser 20, a first flow rectification plate 24 which constitutes a flow rectification member is mounted. The first flow rectification plate 24 is formed by folding a metal plate and includes a first guide portion 24A which is inclined downwardly toward the vehicle body rear side. From a lower end of the first guide portion 24A, a second guide portion 24B extends toward the rear portion of the vehicle body and the second guide portion 24B is arranged horizontally with respect to the vehicle body 14. A vertical wall portion 24C extends upwardly from a rear end of the second guide portion 24B, and a joining portion 24D extends toward the vehicle body rear side from an upper end of the vertical wall portion 24C. The joining portion 24D is connected to a lower end of the front end portion of the diffuser 20 by welding or the like. The first flow rectification plate 24 is mounted on the diffuser 20 in the above-mentioned manner.

Accordingly, the exhaust gas which is discharged downwardly from the space defined between the front end portion of the diffuser 20 and the body portion 18A of the muffler 18 (see an arrow B in FIG. 8) passes through the space defined between the first flow rectification plate 24 and the body portion 18A of the muffler 18. When the exhaust gas passes through in this manner, due to the wind pressure of the air flow U which flows below the floor of the vehicle body 14, the exhaust gas is made to flow toward the first guide portion 24A side. The exhaust gas which is made to flow toward the first guide portion 24A side is guided in the direction inclined downwardly toward the rear side of the vehicle body by the first guide portion 24A and, thereafter, is guided in the direction along the air flow U by the second guide portion 24B, and is merged with the air flow U (see an arrow C in FIG. 8).

Figure 9:
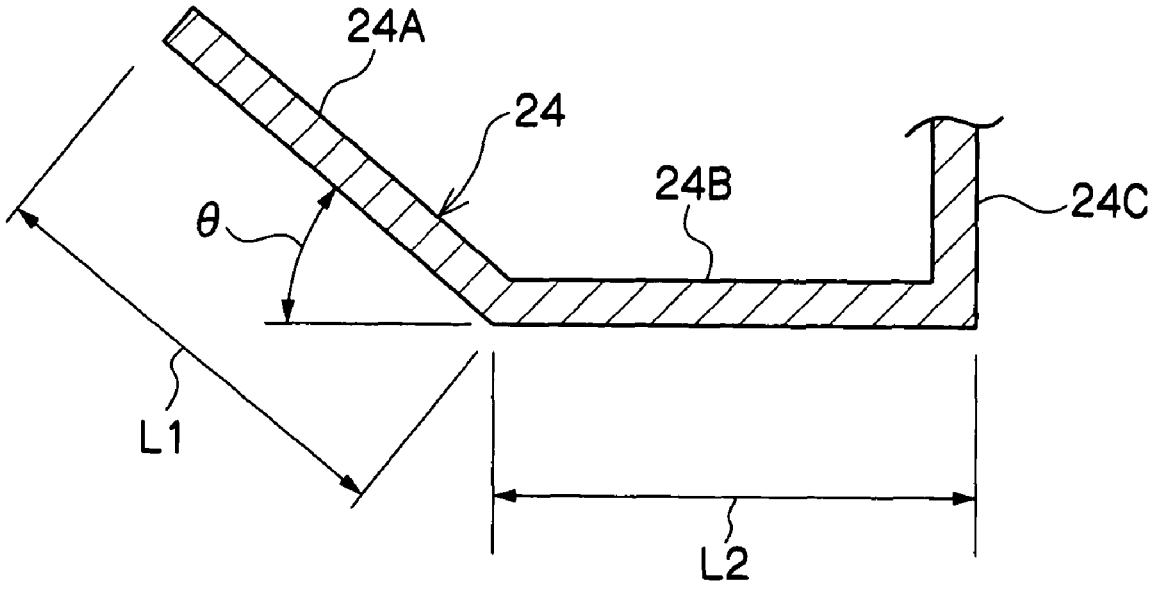
FIG. 9 is an enlarged cross-sectional view showing the partial constitution of a first flow rectification plate mounted on the diffuser shown in FIG. 8.

Here, as shown in FIG. 9, it is preferable to set a length L1 of the first guide portion 24A and a length L2 of the second guide portion 24B of the first flow rectification plate 24 to 5 mm or more. It is preferable to set an inclined angle θ of the first guide portion 24A with respect to the second guide portion 24B to a value as small as possible within a range from 30 degrees to 45 degrees. The same goes for a first guide portion 26A and a second guide portion 26B of the second flow rectification plate 26 which is explained hereinafter.

Figure 3:
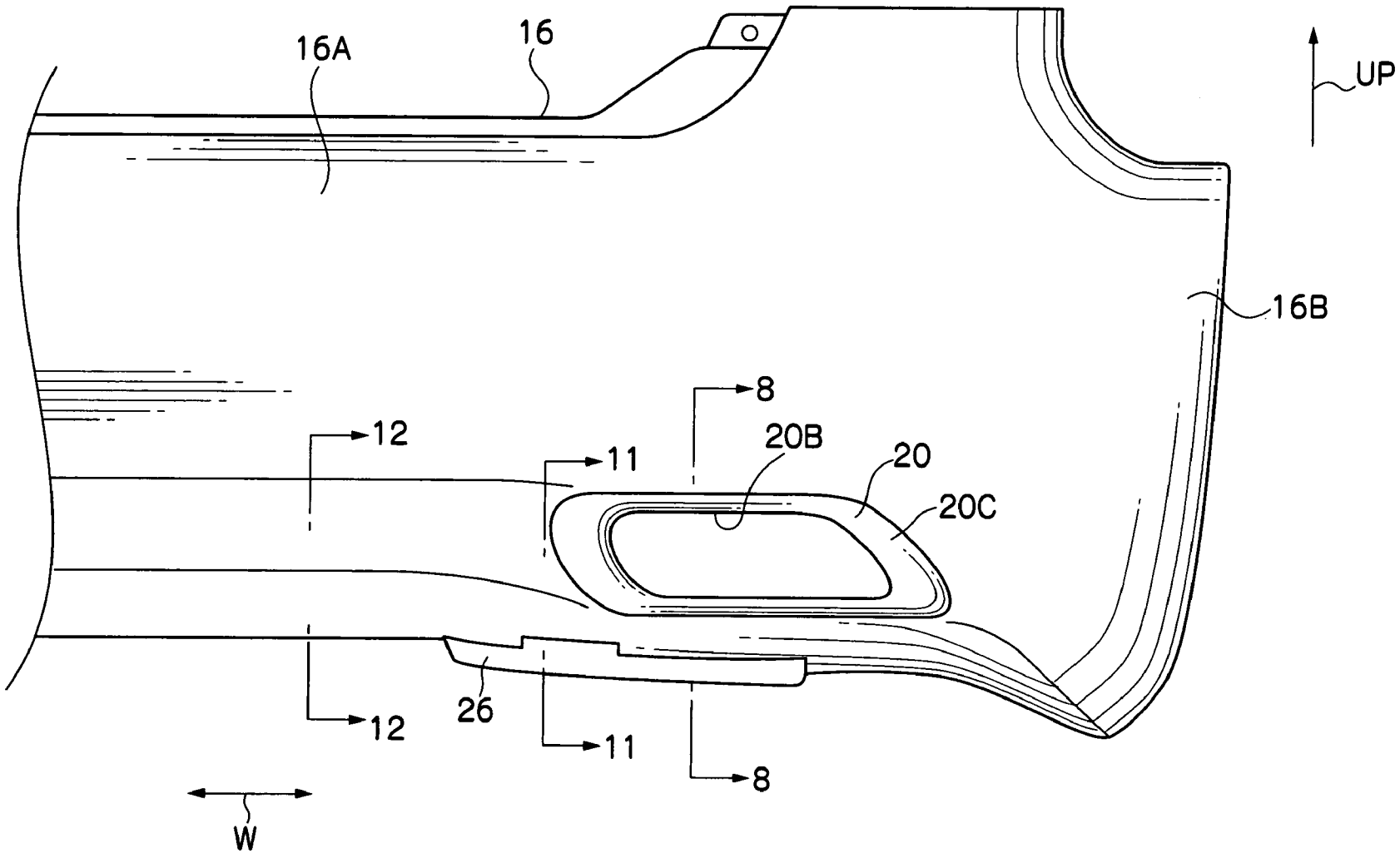
FIG. 3 is a front view of a rear bumper cover of the automobile shown in FIG. 1 in a state that the rear bumper cover is viewed from a rear side of a vehicle body.
Figure 10:
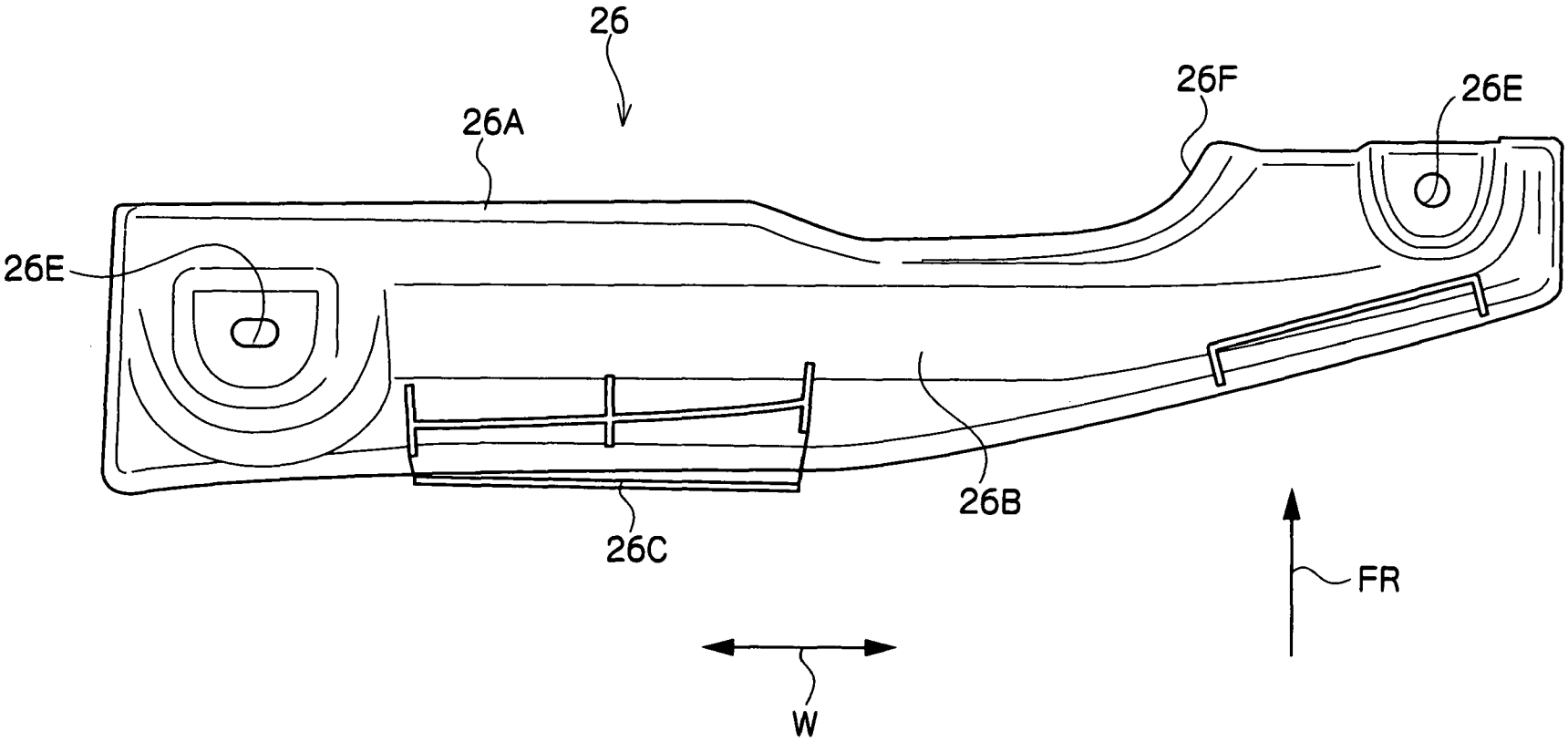
FIG. 10 is a plan view showing the constitution of a second flow rectification plate mounted on the rear bumper cover shown in FIG. 3 and FIG. 4.
Figure 11:
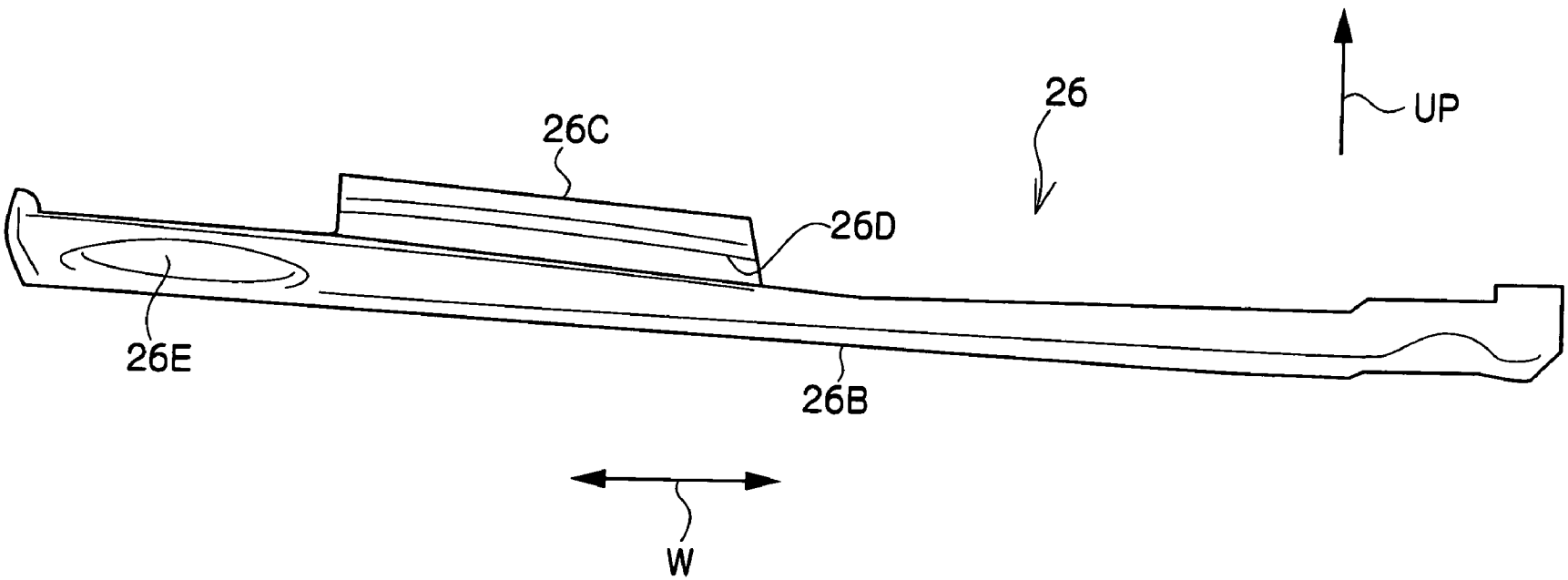
FIG. 11 is a side view showing the constitution of the second flow rectification plate mounted on the rear bumper cover shown in FIG. 3 and FIG. 4.
Figure 12:
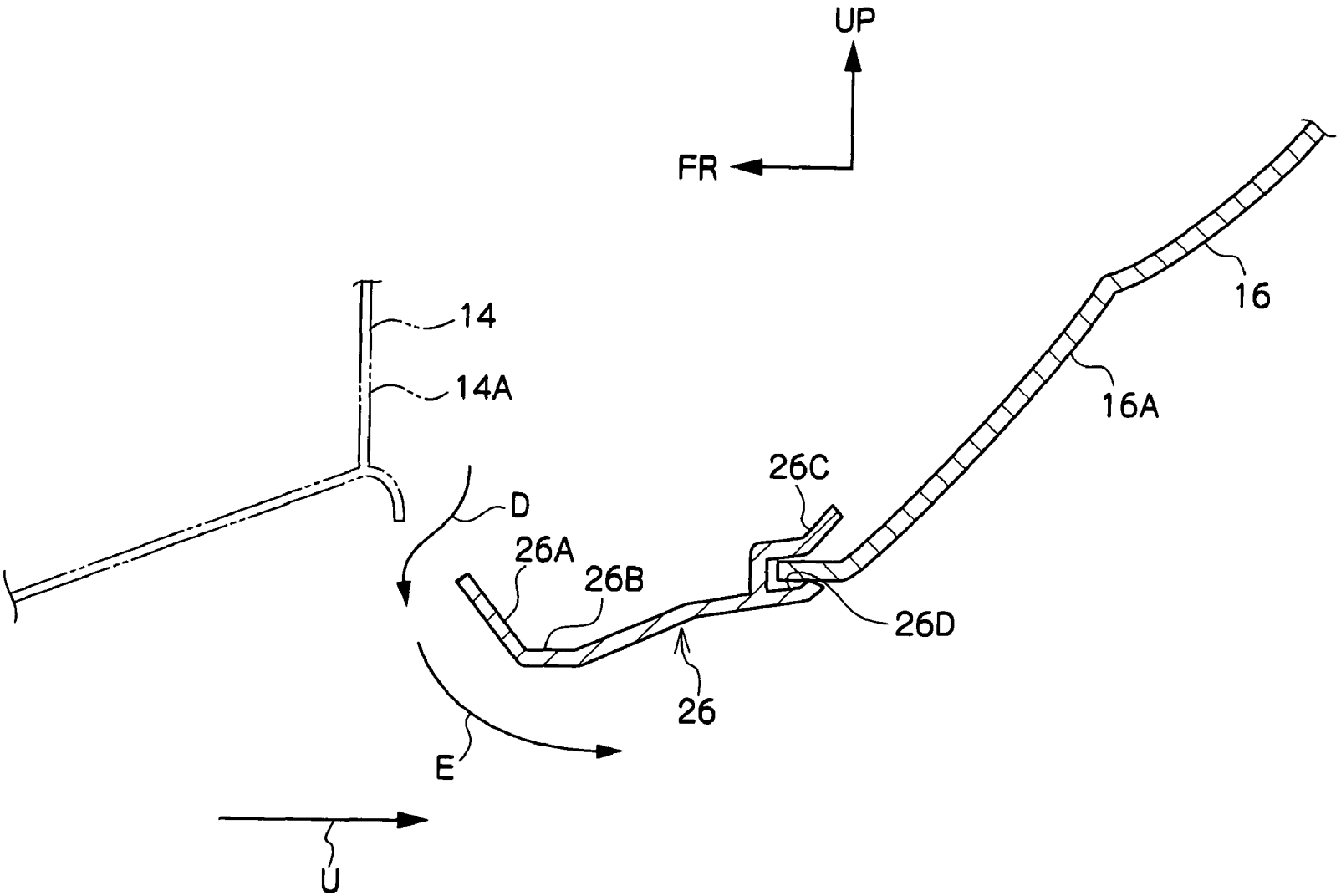
FIG. 12 is a cross-sectional view taken along a line 11-11 in FIG. 3.

Further, according to this embodiment, as shown in FIG. 3 and FIG. 4, the second flow rectification plate 26 which constitutes a flow rectification member is formed below the diffuser 20. The second flow rectification plate 26 is, as shown in FIG. 10 and FIG. 11, formed in an elongated plate-shape and is mounted on a lower end of the cover body 16A in a state that the longitudinal direction of the second flow rectification plate 26 conforms to the vehicle-width direction. As shown in FIG. 12, the second flow rectification member 26 includes the first guide portion 26A which is inclined downwardly toward the vehicle body rear side and the second guide portion 26B which extends from a lower end of the first guide portion 26A toward the rear portion of the vehicle body. Here, as shown in FIG. 4, a cutout portion 26F is formed in a portion of the first guide portion 26A which is arranged right below the diffuser 20.

A mounting lug 26C is mounted on a rear end portion of the second guide portion 26B. In a state that a lower end portion of the cover body 16A is inserted into a mounting groove 26D formed in the mounting lug 26C, a bolt which is inserted into a through hole 26E (see FIG. 10) formed in the second guide portion 26B is fastened to the cover body 16A thus mounting the second flow rectification plate 26 on a lower end of the cover body 16A.

Accordingly, exhaust gas (see an arrow D in FIG. 12) which is discharged downwardly from a space defined between the cover body 16A and the lower back panel 14A passes through a space defined between the second flow rectification plate 26 and the lower back panel 14A. When the exhaust gas passes in this manner, due to a wind pressure of an air flow U which flows below the floor of the vehicle body 14, the exhaust gas is made to flow toward the first guide portion 26A side. The exhaust gas which is made to flow toward the first guide portion 26A is guided in the direction inclined downwardly toward the rear side of the vehicle body by the first guide portion 26A and, thereafter, the exhaust gas is guided in the direction along the air flow U by the second guide portion 26B and is merged into the air flow U (see an arrow E in FIG. 12). Here, no member except for the cover body 16A is arranged at the vehicle-body-rear-side of the second flow rectification plate 26 and, at the same time, the cover body 16A is arranged above the second flow rectification plate 26 and hence, the exhaust gas which passes through the second flow rectification plate 26 does not interfere with the constitutional members of the automobile 12.

Figure 13:
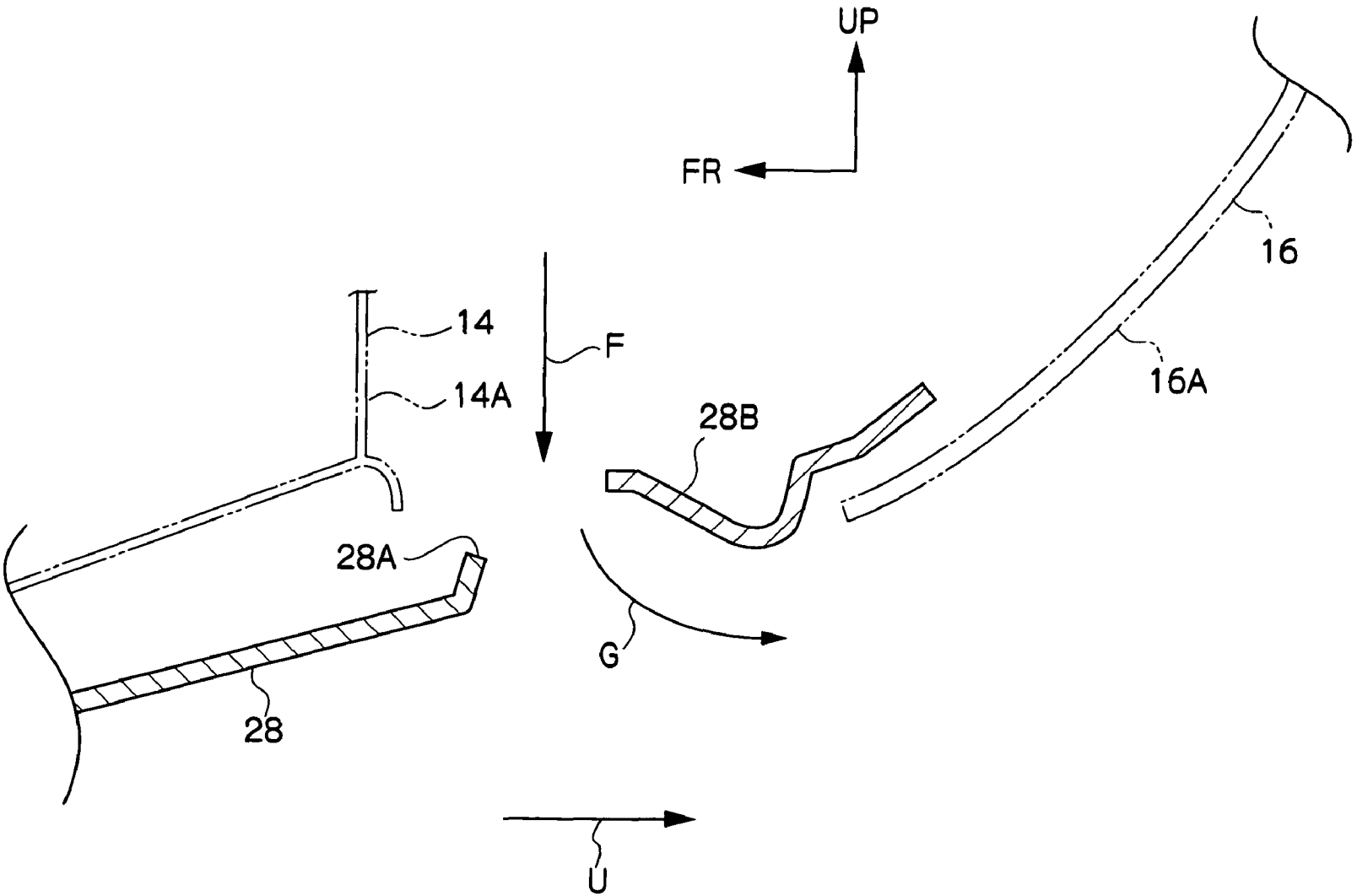
FIG. 13 is a cross-sectional view taken along a line 12-12 in FIG. 3.

Further, in this embodiment, as shown in FIG. 2, on the under-floor of the rear portion of the vehicle body 14, a floor cover 28 is mounted at a center portion thereof in the vehicle width direction. As shown in FIG. 13, a rear end portion of the floor cover 28 and a lower end portion of the cover body 16A overlap with each other. In the rear end portion of the floor cover 28 that is in front of the overlapping portion of the vehicle body, a plurality of discharge holes 28A which is formed of an elongated hole is formed along the vehicle width direction. The exhaust gas which enters in a space defined between the cover body 16A and the lower back panel 14A is discharged downwardly from these discharge holes 28A (see an arrow F in FIG. 13). Hole peripheral portions of the respective discharge holes 28A on the vehicle body rear side constitute inclined portions 28B (flow rectification members) which are inclined downwardly toward the rear side of the vehicle body and hence, the exhaust gas discharged from the respective discharge holes 28A is made to flow toward the inclined portions 28B side due to the wind pressure of the air flow U which flows below the floor of the vehicle body 14. The exhaust gas which is made to flow toward the inclined portion 28B side is guided in the direction inclined downwardly toward the rear side of the vehicle body 14 by the inclined portions 28B, and is merged into the air flow U (see an arrow G in FIG. 13).

Here, although a traveling wind also enters in the space defined between the cover body 16A and the lower back panel 14A, the entered traveling wind is guided in the direction inclined downwardly toward the rear side of the vehicle body by the inclined portions 28B of the respective discharge holes 28A, and is merged into the air flow U.

Next, the manner of operation of this embodiment is explained.

In the automobile 12 having the above-mentioned constitution, the exhaust gas which is discharged downwardly from the space defined between the front end portion of the diffuser 20 and the body portion 18A of the muffler 18 is guided in the direction inclined downwardly toward the rear side of the vehicle body by the inclined portion 20D and the first guide portion 24A of the first flow rectification plate 24 and, thereafter, is guided in the direction along the air flow U which flows below the floor of the vehicle body 14 by the outer periphery 20E of the front end portion of the diffuser 20 and the second guide portion 24B of the first flow rectification plate 24, and is merged into the air flow U. Accordingly, it is possible to prevent the air flow U which flows below the floor of the vehicle body 14 from being disturbed by the exhaust gas which is discharged from the space defined between the front end portion of the diffuser 20 and the main body portion 18A of the muffler 18.

Further, the exhaust gas discharged downwardly from the space defined between the cover body 16A and the lower back panel 14A is guided in the direction inclined downwardly toward the rear side of the vehicle body by the first guide portion 26A of the second flow rectification plate 26 and, thereafter, is guided in the direction along the air flow U which flows below the floor of the vehicle body 14 by the second guide portion 26B of the second flow rectification plate 26, and is merged to the air flow U. Accordingly, it is possible to prevent the air flow U which flows below the floor of the vehicle body 14 from being disturbed by the exhaust gas discharged from the space defined between the cover body 16A and lower back panel 14A.

Further, the exhaust gas discharged from the discharge holes 28A formed in the floor cover 28 is guided in the direction inclined downwardly toward the rear side of the vehicle body by the inclined portions 28B formed on the hole peripheral portions of the discharge holes 28A, and is guided in the direction along the air flow U which flows below the floor of the vehicle body 14, and is merged into the air flow U. Accordingly, it is possible to prevent the air flow U which flows below the floor of the vehicle body 14 from being disturbed by the exhaust gas discharged from the discharge holes 28A formed in the floor cover 28.

Further, in this embodiment, the exhaust gas can be guided by two guide portions on the first flow rectification plate 24 and the second flow rectification plate 26 and hence, the constitution of the flow rectification member can be simplified.

Here, in the above-mentioned embodiment, the first flow rectification plate 24 and the second flow rectification plate 26 are configured to include first guide portions 24A, 26A and the second guide portions 24B, 26B and to exhibit bent cross-sectional shapes. However, the flow rectification plates are not limited to the above-mentioned cross-sectional shapes and may be formed in an arcuate cross-sectional shape. In this case, the flow rectification plates are configured to guide the exhaust gas in the direction inclined toward the rear side of the vehicle body by portions that have tangents to the arc are inclined.

Further, in the above-mentioned embodiment, the first flow rectification plate 24 and the second flow rectification plate 26 are formed as separate bodies with respect to the diffuser 20 and the rear bumper cover 16. However, the present invention is not limited to such a constitution, and the first flow rectification plate 24 may be integrally formed with the diffuser 20 and the second flow rectification plate 26 may be integrally formed with the rear bumper cover 16.

What is claimed is:

1. An automobile rear structure comprising:

a rear-side arranged member which is arranged on a vehicle-body rear side of a muffler and is configured to interfere with exhaust gas discharged from the muffler so as to make a portion of the exhaust gas flow downwardly; and a flow rectification member which is arranged below the muffler and guides the downwardly flowing exhaust gas in the direction along an air flow flowing below the floor of the vehicle body to merge the downwardly flowing exhaust gas into the air flow, wherein the rear-side arranged member includes a diffuser which is formed in substantially a cylindrical shape and which houses a muffler pipe of the muffler inside an opening portion on a front-end side of the diffuser, and which discharges the exhaust gas discharged from the muffler pipe from an opening end portion of a rear-end side of the diffuser, the portion of the exhaust gas is discharged downwardly from a space defined between a front end portion of the diffuser and a body portion of the muffler, and the flow rectification member is formed by a lower portion of the front end portion of the diffuser being folded toward a radial inside.

2. An automobile rear structure according to claim 1, wherein the rear-side arranged member comprises a rear bumper cover, a floor cover with a discharge hole formed therein in the vicinity of a rear end portion thereof in the vehicle longitudinal direction, the floor cover being mounted at an under-floor of a rear portion of the vehicle body in a state such that the rear end portion overlaps a lower end portion of the rear bumper cover, a third portion of the exhaust gas is discharged downwardly from the discharge hole, and the flow rectification member comprises an inclined portion provided at a peripheral portion of the discharge hole.

3. An automobile rear structure according to claim 2, wherein the discharge hole is an elongated hole which is formed in an elongated manner along the vehicle width direction.

4. An automobile rear structure according to claim 2, wherein the flow rectification member includes a flow rectification plate comprising a first guide portion inclined downwardly toward the rear-side of the vehicle body, and a second guide portion which extends toward the rear of the vehicle body from a lower end of the first guide portion.

5. An automobile rear structure according to claim 1, wherein the rear-side arranged member comprises a rear bumper cover, a second portion of the exhaust gas is discharged downwardly from a space defined between the rear bumper cover and the vehicle body, and the flow rectification member is provided at a lower portion of the rear bumper cover.

6. An automobile rear structure according to claim 5, wherein the flow rectification member includes a flow rectification plate comprising a first guide portion inclined downwardly toward the rear-side of the vehicle body, and a second guide portion which extends toward the rear of the vehicle body from a lower end of the first guide portion.

7. An automobile rear structure according to claim 1, wherein the flow rectification member includes a flow rectification plate which is mounted at the lower portion of the front end portion of the diffuser.

8. An automobile rear structure according to claim 1, wherein the flow rectification member includes an inclined portion which is folded toward a radial inside at the lower portion of the front end portion of the diffuser and is inclined downwardly toward a rear portion of the vehicle body, and a portion which is formed continuous with the inclined portion and extends along rearward to the vehicle body around an outer periphery of the front end portion of the diffuser.

9. An automobile rear structure according to claim 1, wherein the flow rectification member includes a flow rectification plate which comprises a first guide portion inclined downwardly toward the rear-side of the vehicle body, and a second guide portion which extends toward the rear of the vehicle body from a lower end of the first guide portion.

* * * * *